United States Patent [19]

Lo

[11] Patent Number: 5,048,830

[45] Date of Patent: Sep. 17, 1991

[54] RACKET FRAME WITH SHOCK ABSORBING CHARACTERISTICS

[76] Inventor: Kun-Nan Lo, No. 33, Hsiang-Ho Rd., Li-Lin Tsun, Tan-Tzu Hsiang, Taichung Hsien, Taiwan

[21] Appl. No.: 585,761

[22] Filed: Sep. 20, 1990

[51] Int. Cl.[5] ..... A63B 49/02

[52] U.S. Cl. ..... 273/73 C; 273/73 G

[58] Field of Search ..... 273/73 R, 73 C, 73 D, 273/73 F, 73 G, 73 H

[56] References Cited

U.S. PATENT DOCUMENTS

| | | | |
|---|---|---|---|
| 3,647,211 | 3/1972 | Doessel et al. | 273/73 C |
| 4,145,047 | 3/1979 | Nagamoto et al. | 273/73 G X |
| 4,664,380 | 5/1987 | Kuebler | 273/73 C |
| 4,690,405 | 9/1987 | Frolow | 273/73 C |
| 4,911,444 | 3/1990 | Yoneyama | 273/73 F X |
| 4,919,438 | 4/1990 | Yoneyama | 273/73 G X |
| 4,997,186 | 3/1991 | Carr | 273/73 G X |

FOREIGN PATENT DOCUMENTS

| | | | |
|---|---|---|---|
| 23826 | 8/1935 | Australia | 273/73 C |
| 482164 | 4/1938 | United Kingdom | 273/73 C |

*Primary Examiner*—Edward M. Coven
*Assistant Examiner*—William E. Stoll
*Attorney, Agent, or Firm*—Panitch Schwarze Jacobs & Nadel

[57] ABSTRACT

The cross section of the looped frame portion 20 of a racket varies with the changing thickness thereof as measured in a direction perpendicular to the plane of the looped frame portion. The looped frame portion has a first and a second portion 21, 22 divided by the longitudinal axis of the racket. The first portion 21 has the smallest cross-section at first point A2 adjacent to an uppermost point of the frame opposite to the throat of the racket and the largest cross-section at second point B2 adjacent to the throat. The second portion 22 has the largest cross-section at a point A1 which is symmetrically positioned on the racket frame with the point A2 of the smallest cross-section of the first portion 21 and the smallest cross-section at another point B1 which is symmetrically positioned on the racket frame with the point B2 of the largest cross-section of the first portion.

3 Claims, 4 Drawing Sheets

RACKET FRAME WITH SHOCK ABSORBING CHARACTERISTICS

BACKGROUND OF THE INVENTION

This invention relates to a racket frame, and particularly to the construction of the looped portion of a racket frame.

In playing tennis, it is a common phenomenon that shocks are initiated at the string web which strikes a ball and then transmitted, through the looped frame, the shaft and the grip of the racket, to the hand of the player. The player may thus easily become fatigued and even injured. In order to alleviate the problem of shock, shock absorbing devices are provided in the art. Most racket shock absorbing devices are accessory elements which must be added to the looped portion or to the string web of a racket. In the 15 rackets incorporating these shock absorbing devices, the strings have to be passed through these shock absorbing elements thereby causing inconveniences in fabrication.

SUMMARY OF THE INVENTION

An object of the invention is to provide a racket frame with an improved construction which itself can reduce shock to the user's arm without the need to provide any additional elements.

According to the present invention, the looped frame portion of a racket frame includes a first and second portion divided by a longitudinal axis which extends along the shaft of the racket and passes through the throat of the racket and an uppermost point opposite the throat. The looped frame portion has a gradually varying cross-section in full length. The first portion has a first point of smallest cross-section adjacent to the uppermost point and a second point of largest cross-section adjacent to the throat. The second portion has a third point of largest cross-section adjacent to the uppermost point and a fourth point of smallest cross-section adjacent to the throat. The first and third points are symmetrically positioned on the racket frame with respect to the longitudinal axis. The second and fourth points are symmetrically positioned on the racket frame with respect to the longitudinal axis.

In an aspect of the invention, the cross-section of the looped frame portion varies by changes in the thickness of said looped frame portion as measured in a direction perpendicular to the plane of said looped frame portion.

The exemplary preferred embodiment will be described in detail with reference to the accompanying drawings, in which:

DETAILED DESCRIPTION OF THE PREFERRED EMBODIMENT

Figure 1:
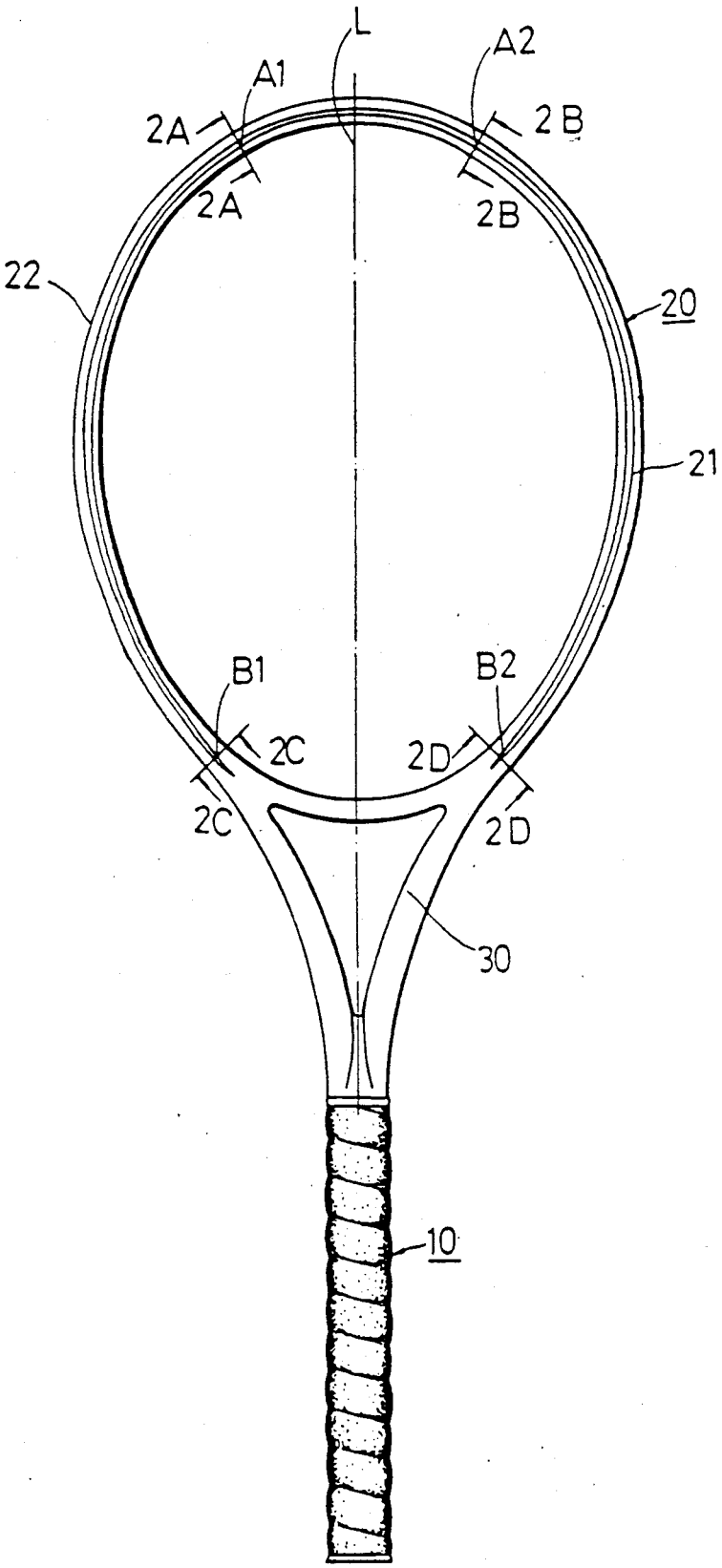
FIG. 1 is a perspective view of a racket frame embodying the present invention.
Figure 2A:
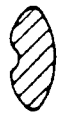
FIG. 2A is a sectional view taken along line 2A—2A of FIG. 1.
Figure 2B:
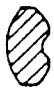
FIG. 2B is a sectional view taken along line 2B—2B of FIG. 1.
Figure 2C:
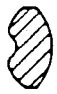
FIG. 2C is a sectional view taken along line 2C—2C of FIG. 1.
Figure 2D:
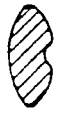
FIG. 2D is a sectional view taken along line 2D—2D of FIG. 1.
Figure 3:
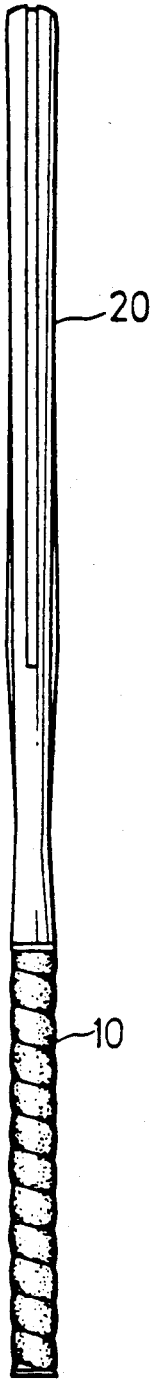
FIG. 3 is a left side plan view of the racket frame of FIG. 1.
Figure 4:
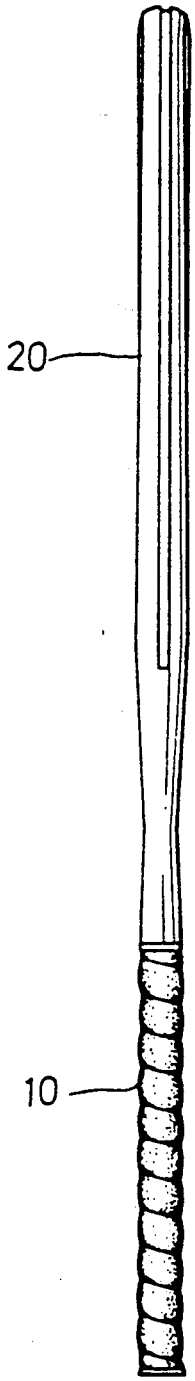
FIG. 4 is a right side plan view of the racket frame of FIG. 1.

Referring to FIGS. 1 to 4, a racket frame comprises a shaft portion 10, a looped frame portion 20 and a throat 30 formed between the shaft and the looped frame 20. The looped frame portion 20 has a first portion 21 and a second portion 22 respectively located on two sides of the longitudinal axis L of the racket frame. The longitudinal axis L extends along the shaft 10 and passes through an uppermost point of the frame 20 and the throat 30.

The cross-section of the looped frame 20 is not uniform. The first portion 21 has the smallest cross-section at point A2 and the largest cross-section at point B2. The second portion 22 has the largest cross section at point A1 and the smallest cross section at point B1. The cross-section of the looped frame portion 20 increases gradually from point B1 to A1, decreases gradually from point A1 to A2, increases gradually from point A2 to point B2, decreases from point B2 to the throat section 30, and increases from point B1 to the throat section 30.

In an example, the cross section of the looped frame portion 20 varies with the changing thickness of the looped frame portion 20 as measured in a direction perpendicular to the plane of the looped frame 20. Preferably, the smallest thickness is 22 mm or 25 mm and the largest thickness is 28 mm.

Figure 5:
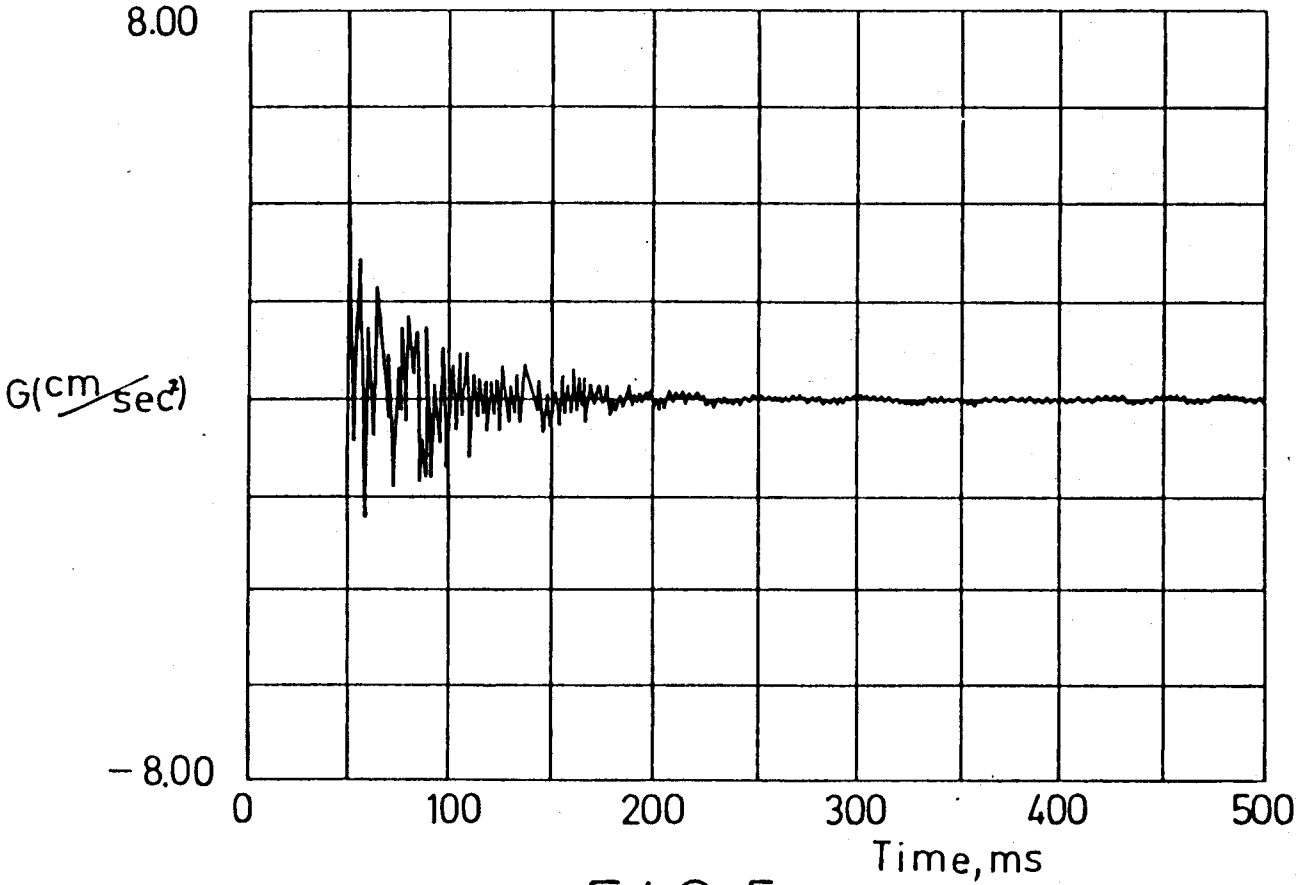
FIGS. 5 and 6 respectively show the vibrational frequencies of the racket frame of the present invention and a conventional racket frame, as determined by experimentation.
Figure 6:
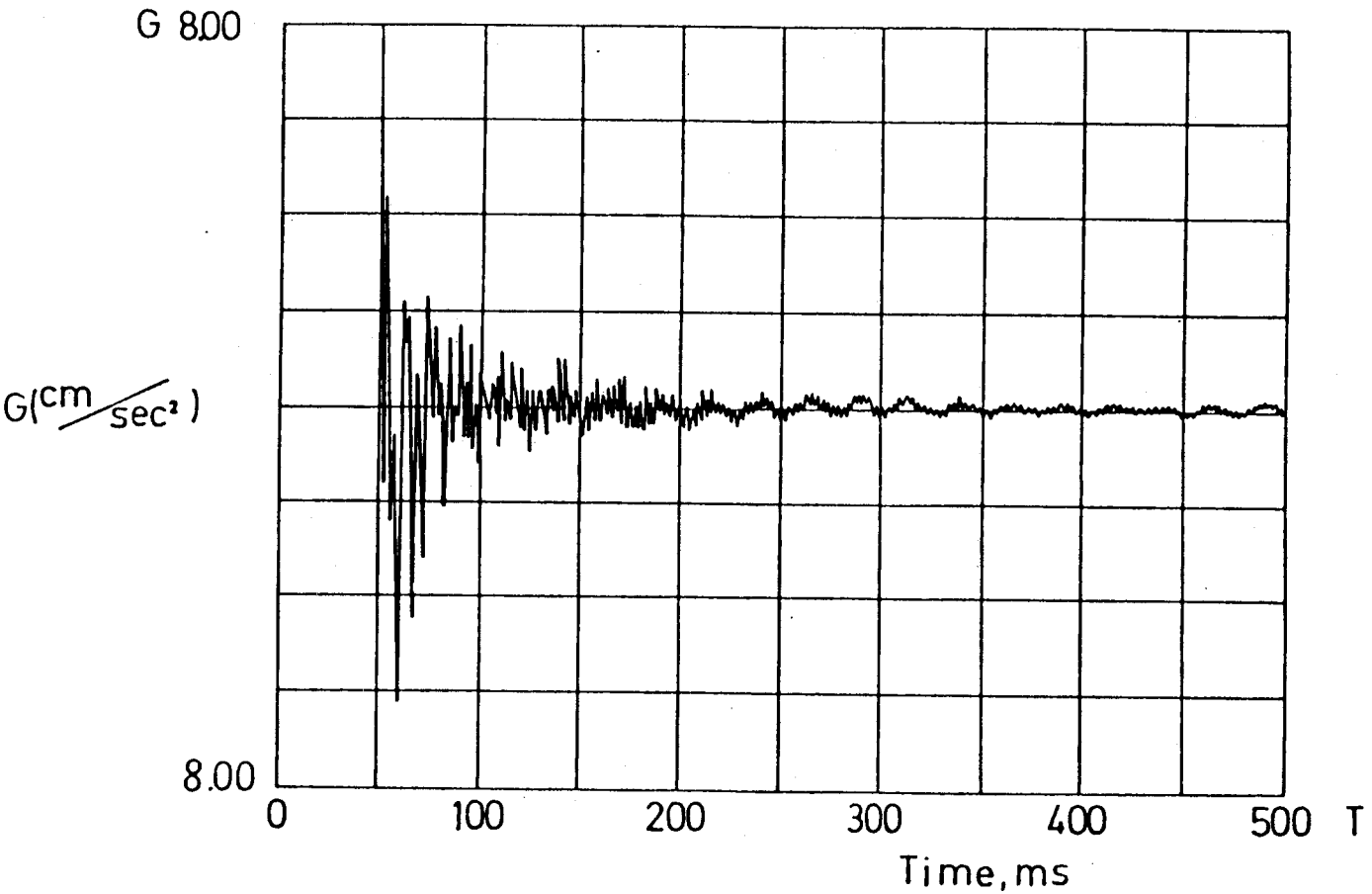

FIGS. 5 and 6 shows vibration frequencies as determined by tests performed on a racket constructed according to the present invention and on a conventional racket. In FIG. 5, the greatest peak is 4.2 G and the vibration diminishing period is 63.83 MS. In FIG. 6, the greatest peak is 6.2 G and the vibration diminishing period is 89.10 MS. The results show that the racket incorporating the present invention vibrates less than the conventional racket does.

I claim:

1. A racket frame having a shaft portion, a looped frame portion, and a throat between said looped frame portion and said shaft portion, said looped frame portion having an uppermost point opposite to said throat, and a first and second portion divided by a longitudinal axis which extends along said shaft portion and passes through said uppermost point and said throat, said looped frame portion having a gradually varying cross-section, said first portion having a first point of smallest cross-section adjacent to said uppermost point and a second point of largest cross-section adjacent to said throat, said second portion having a third point of largest cross-section adjacent to said uppermost point and a fourth point of smallest cross-section adjacent to said throat, said first and third point being symmetrically positioned on the racket frame with respect to said longitudinal axis, said second and fourth point being symmetrically positioned on the racket frame with respect to said longitudinal axis.

2. A racket frame as claimed in claim 1, wherein said cross-section of said looped frame portion gradually increases from said fourth point to said third point, decreases from said third point to said first point, increases from said first point to said second point, decreases from said second point to said throat, and increases from said fourth point to said throat.

3. A racket frame as claimed in claim 2, wherein said cross-section varies with the changing thickness of said looped frame portion as measured in a direction perpendicular to the plane of said looped frame portion.

* * * * *